US011501738B1

(12) United States Patent
Chen

(10) Patent No.: US 11,501,738 B1
(45) Date of Patent: Nov. 15, 2022

(54) BRIGHTNESS ADJUSTMENT METHOD AND RELATED DISPLAY SYSTEM

(71) Applicant: Wistron Corporation, New Taipei (TW)

(72) Inventor: Feng-Yuan Chen, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 17/504,477

(22) Filed: Oct. 18, 2021

(30) Foreign Application Priority Data

Jul. 5, 2021 (TW) ..... 110124631

(51) Int. Cl.
*G09G 5/10* (2006.01)

(52) U.S. Cl.
CPC ..... *G09G 5/10* (2013.01); *G09G 2320/0626* (2013.01); *G09G 2354/00* (2013.01); *G09G 2360/144* (2013.01); *G09G 2360/16* (2013.01)

(58) Field of Classification Search
CPC ..... G09G 5/10; G09G 2320/0626; G09G 2320/08; G09G 2360/16; G09G 2360/144; G09G 2354/00
See application file for complete search history.

(56) References Cited

U.S. PATENT DOCUMENTS

| | | | | |
|---|---|---|---|---|
| 10,447,961 | B2 * | 10/2019 | Pines | G09G 5/00 |
| 10,810,970 | B1 * | 10/2020 | Miyata | H04N 5/57 |
| 11,297,292 | B2 * | 4/2022 | Aoyanagi | H04N 9/3194 |
| 2017/0169794 | A1 * | 6/2017 | Nagano | G09G 5/14 |
| 2018/0338104 | A1 * | 11/2018 | Pines | H04N 5/58 |
| 2020/0312272 | A1 * | 10/2020 | Miyata | G09G 5/10 |
| 2021/0321067 | A1 * | 10/2021 | Aoyanagi | G09G 5/00 |

FOREIGN PATENT DOCUMENTS

| | | | | |
|---|---|---|---|---|
| CN | 108701438 | A | 10/2018 | |
| CN | 111724752 | A | 9/2020 | |
| JP | 2019220951 | A * | 12/2019 | G09G 3/2003 |

* cited by examiner

*Primary Examiner* — Patrick F Marinelli
(74) *Attorney, Agent, or Firm* — Winston Hsu

(57) ABSTRACT

A brightness adjustment method for a display system is disclosed. The display system includes a high dynamic range (HDR) display device, wherein the HDR display device is utilized for displaying an image. The brightness adjustment method includes detecting a distance between the HDR display device and a user, updating a brightness of the image according to the distance, calculating metadata corresponding to the image according to the brightness of the image and determining the image displayed on the HDR display device according to the calculated metadata corresponding to the image.

11 Claims, 5 Drawing Sheets

BRIGHTNESS ADJUSTMENT METHOD AND RELATED DISPLAY SYSTEM

BACKGROUND OF THE INVENTION

1. Field of the Invention

The present invention relates to a brightness adjustment method and a related display system, and more particularly, to a brightness adjustment method and a related display system capable of dynamically adjusting a brightness of the display.

2. Description of the Prior Art

High dynamic range (HDR) images may present more details using bright and dark colors. Conventional display devices can display images with higher contrast, higher brightness and more colors via the HDR function. The HDR function of the conventional display may be turned on or off via the operating system. When the HDR function is turned on, the display is configured to display the brightness corresponding to the image according to the image signal from the host system and the metadata of the image, which is related to the display device. When the brightness of the HDR display is too high, however, the brightness of the content of the image may be at a level, e.g. 1400 nits, at which the user may feel uncomfortable. On the other hand, when the brightness of the HDR display is too low, dark regions in the image cannot be clearly displayed. Therefore, improvements are necessary to the conventional techniques.

SUMMARY OF THE INVENTION

In light of this, the present invention provides a brightness adjustment method and a related display system to dynamically adjust the brightness of the display.

An embodiment of the present invention discloses a brightness adjustment method for a display system. The display system includes a high dynamic range (HDR) display device, wherein the HDR display device is utilized for displaying image. The brightness adjustment method comprises: detecting a distance between the HDR display device and a user; updating a brightness of the image according to the distance; calculating metadata corresponding to the image according to the brightness of the image; and determining the image displayed on the HDR display device according to the calculated metadata corresponding to the image.

Another embodiment of the present invention discloses a display system, comprising: a sensing module, configured to detect a distance between a user; a high dynamic range (HDR) display device, configured to display an image, comprising: a display scaler, coupled to the sensing module, configured to update a brightness of the image; a display panel, coupled to the display scaler; and a host system, coupled to the HDR display device, configured to provide the metadata of the image; wherein the metadata of the image and the brightness of the image corresponding to the distance are generated according to the distance sensed by the sensing module, and the display scaler is configured to display the image of the HDR display device according to the calculated metadata of the image and the brightness of the image corresponding to the distance.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
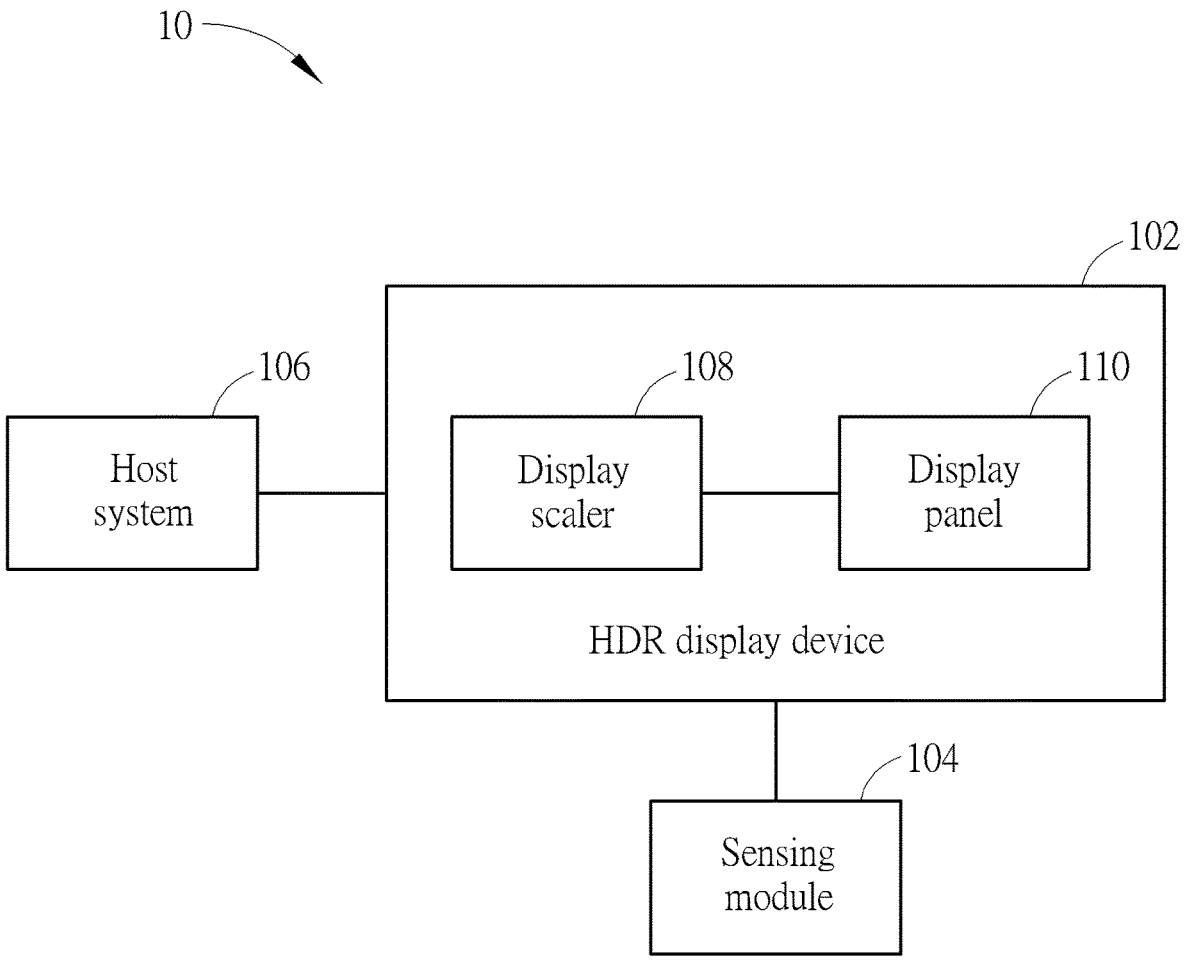
FIG. 1 is a schematic diagram of a display system according to an embodiment of the present invention.

Refer to FIG. 1, which is a schematic diagram of a display system 10 according to an embodiment of the present invention. The display system 10 includes a high dynamic range (HDR) display device 102, a sensing module 104 and a host system 106. The HDR display device 102 includes a display scaler 108 and a display panel 110 for displaying an image. The sensing module 104 is configured to detect a distance between the HDR display device 102 and a user. More specifically, the sensing module 104 may be a distance sensor for measuring a distance between the HDR display device 102 and a face of the user, wherein the distance sensor may detect a characteristic point on the user's face, e.g. eyes or nose. Alternatively, a location between the eyes of the face may be utilized as a measurement point. The user's eyes are utilized as the measurement point for the following embodiments, but this is not limited thereto. Other characteristic points that can be utilized as measurement points are within the scope of the present invention. The display scaler 108 may be a digital signal interface (DVI) scaler connected to the sensing module 104 via an inter-integrated circuit (I2C) interface and connected to the display panel 110 via a backlight control interface and a panel interface, for measuring the distance between the HDR display device 102 and the user's eyes to adjust a brightness of the image of the HDR display device 102. The host system 106 may be a processor or a personal computer with a computing unit, which is connected to the display scaler 108 of the HDR display device 102 via the I2C interface. The host system 106 is configured to calculate metadata of the image according to the brightness of the image, and determine the image displayed on the HDR display device 102 according to the metadata of the image. The display system 10 according to an embodiment of the present invention may calculate the metadata of the HDR display device 102 when the high dynamic range function is activated, such that the HDR display device 102 may adjust a maximal brightness of the HDR display device 102 according to the distance between the HDR display device 102 and the user's eyes.

In detail, the display scaler 108 is configured to adjust the brightness of the image of the HDR display device 102 according to the distance between the HDR display device 102 and the eyes, wherein the brightness is related to at least one of a Maximum Content Light Level (MaxCLL), a Maximum Frame Average Light Level (MaxFALL) and a Minimum Content Light Level (MinCLL) of the HDR display device 102. Therefore, the display scaler 108 may update the MaxCLL and the MaxFALL according to the distance between the HDR display device 102 and the eyes sensed by the sensing module 104, and the display scaler 108 may update the MaxCLL and the MaxFALL. In an embodiment, the display scaler 108 may notify the host system 106 to read the updated the MaxCLL and the MaxFALL. For example, the host system 106 may read extended display identification data (EDID) of the HDR display device 102 to obtain the MaxCLL and the MaxFALL of the HDR display device 102.

The host system 106 may read the updated MaxCLL and the updated MaxFALL after receiving the notification from the display scaler 108 and calculate the metadata of the image accordingly. Then, the host system 106 may transmit the metadata to the display scaler 108, such that the display scaler 108 may determine the image displayed on the display panel 110 of the HDR display device 102 according to the calculated metadata and corresponding pixel data.

In another embodiment, the host system 106 may read the EDID to obtain the MaxCLL and the MaxFALL of the HDR display device 102, and calculate and update the MaxCLL and the MaxFALL according to the distance between the HDR display device 102 and the user's eyes. Meanwhile, the host system 106 is configured to calculate the metadata of the image. Then, the host system 106 transmits the metadata, the calculated MaxCLL and the calculated MaxFALL to the display scaler 108, such that the display scaler 108 may determine the image displayed on the display panel 110 of the HDR display device 102 according to the adjusted metadata and the corresponding pixel data. In this situation, the host system 106 is configured to calculate the MaxCLL and the MaxFALL and then the calculated MaxCLL and the calculated MaxFALL are updated by the display scaler 108. The display scaler 108 does not need to calculate the MaxCLL and the MaxFALL.

Notably, in another embodiment, the display scaler 108 may calculate the metadata provided by the host system 106 according to the updated MaxCLL and the updated the MaxFALL, and then determine the image displayed on the HDR display device 102 according to the calculated metadata, the updated the MaxCLL and the updated MaxFALL. In this embodiment, the display scaler 108 is not required to notify the host system 106 to read the MaxCLL and the MaxFALL adjusted by the HDR display device 102.

In addition, in an embodiment, the display system 10 according to an embodiment of the present invention may adjust the brightness of the image of the HDR display device 102 according to an ambient light where the HDR display device 102 is located. The sensing module 104 may sense an intensity of the ambient light, such that the host system 106 or the display scaler 108 of the display system 10 may adjust the brightness of the image of the HDR display device 102 according to the distance between the HDR display device 102, the user's eyes and the ambient light.

Referring to the method of the display scaler 108 adjusting the brightness of the image of the HDR display device 102 according to the distance between the HDR display device 102 and the user's eyes, the display scaler 108 may reduce the MaxFALL of the HDR display device 102 when the distance is smaller than a first distance; and increase the MinCLL of the HDR display device 102 when the distance is larger than a second distance. For example, when a high dynamic range function of the HDR display device 102 is activated, the MaxCLL is 1000 nits, the MaxFALL is 400 nits and the MinCLL is 0.5 nits. When the sensing module 104 detects that the distance between the HDR display device 102 and the user's eyes is larger than 100 cm, the display scaler 108 may adjust the brightness of the image of the HDR display device 102 as follows: 100% of the MaxCLL (i.e. 1000 nits), 100% of the MaxFALL (i.e. 400 nits), and 150% of the MinCLL (i.e. 0.75 nits). When the sensing module 104 detects that the distance between the HDR display device 102 and the user's eyes is smaller than 30 cm, the display scaler 108 may adjust the brightness of the image of the HDR display device 102 as follows: 70% of the MaxCLL (i.e. 700 nits), 70% of the MaxFALL (i.e. 280 nits), and 100% of the MinCLL (i.e. 0.5 nits). When the sensing module 104 detects that the distance between the HDR display device 102 and the user's eyes is 50 cm, the display scaler 108 may adjust the brightness of the image of the HDR display device 102 as follows: 70% of the MaxCLL (i.e. 700 nits), 100% of the MaxFALL (i.e. 400 nits), and 100% of the MinCLL (i.e. 0.5 nits).

In the above embodiments, the first distance may be 30 cm, such that when the distance between the HDR display device 102 and the user's eyes is smaller than 30 cm, the MaxFALL of the HDR display device 102 is reduced. The second distance may be 100 cm, such that when the distance between the HDR display device 102 and the user's eyes is larger than 100 cm, the MinCLL of the HDR display device 102 is increased. When the distance between the HDR display device 102 and the user's eyes is between 30 and 100 cm, the MaxCLL of the HDR display device 102 is reduced.

In another embodiment, the host system 106 may replace the display scaler 108 to adjust the brightness of the image of the HDR display device 102 according to the distance between the HDR display device 102 and the user's eyes. In this situation, the display scaler 108 only needs to receive and update the MaxCLL and the MaxFALL calculated by the host system 106.

A usage scenario of the display system 10 according to an embodiment of the present invention may adjust the brightness of the HDR display device 102 according to the distance between the HDR display device 102 and the user's eyes sensed by the sensing module 104. When the distance between the HDR display device 102 and the user's eyes is over 100 cm, 100% of the MaxCLL is displayed on the display panel 110. In order to display a lowest brightness area of the displayed image, the display scaler 108 may increase the MinCLL accordingly. When the distance between the HDR display device 102 and the user's eyes is between 30 and 100 cm, an operation distance between the user and the HDR display device 102 is normal, so the display scaler 108 may slightly adjust the MaxCLL. When the distance between the HDR display device 102 and the user's eyes is smaller than 30 cm, meaning the operation distance between the user and the HDR display device 102 is too close, the display scaler 108 may reduce the MaxCLL and the MaxFALL accordingly.

Figure 2:
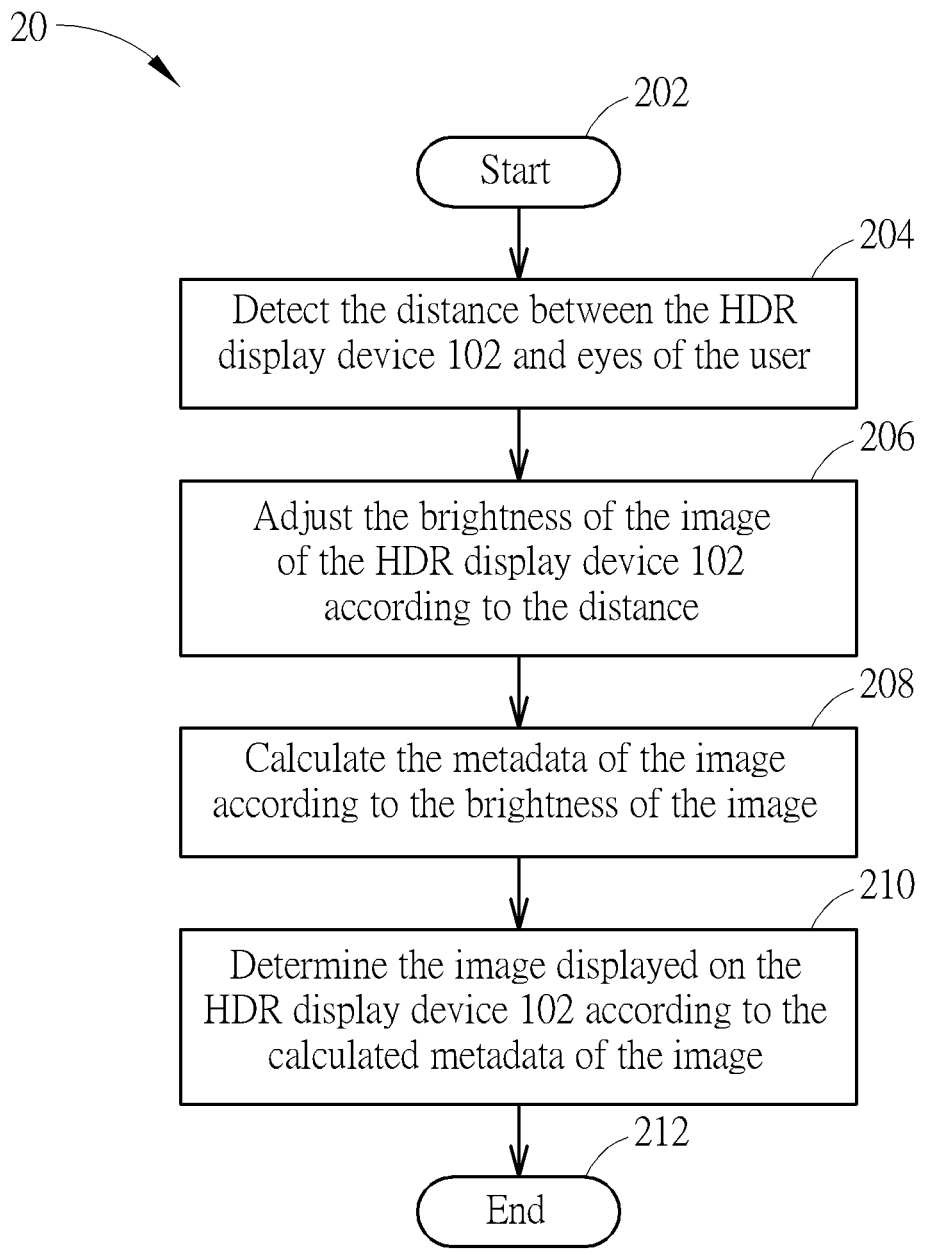
FIG. 2 is a schematic diagram of a brightness adjustment method according to an embodiment of the present invention.
Figure 3:
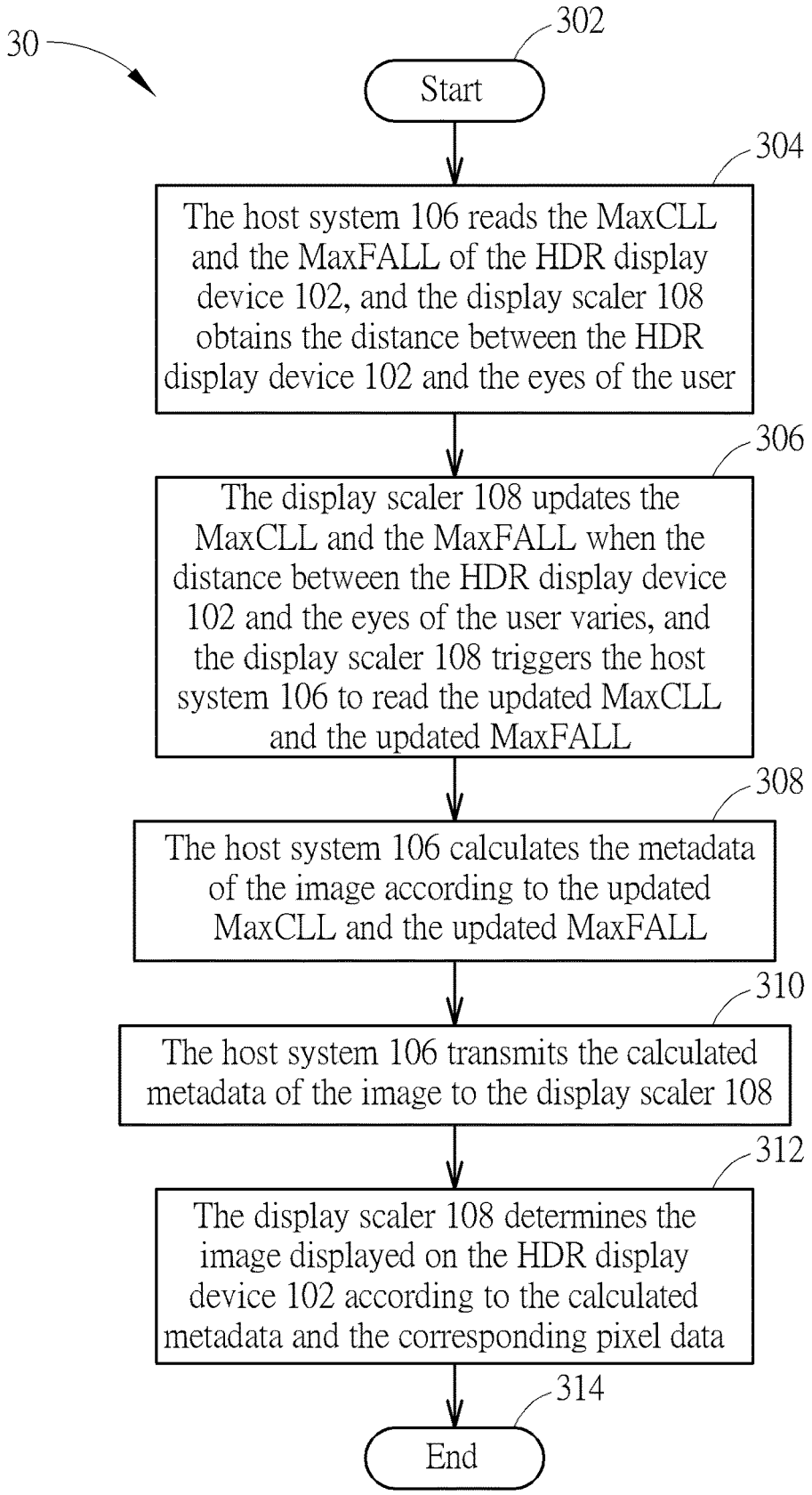
FIGS. 3-5 are schematic diagrams of another brightness adjustment method according to an embodiment of the present invention.
Figure 4:
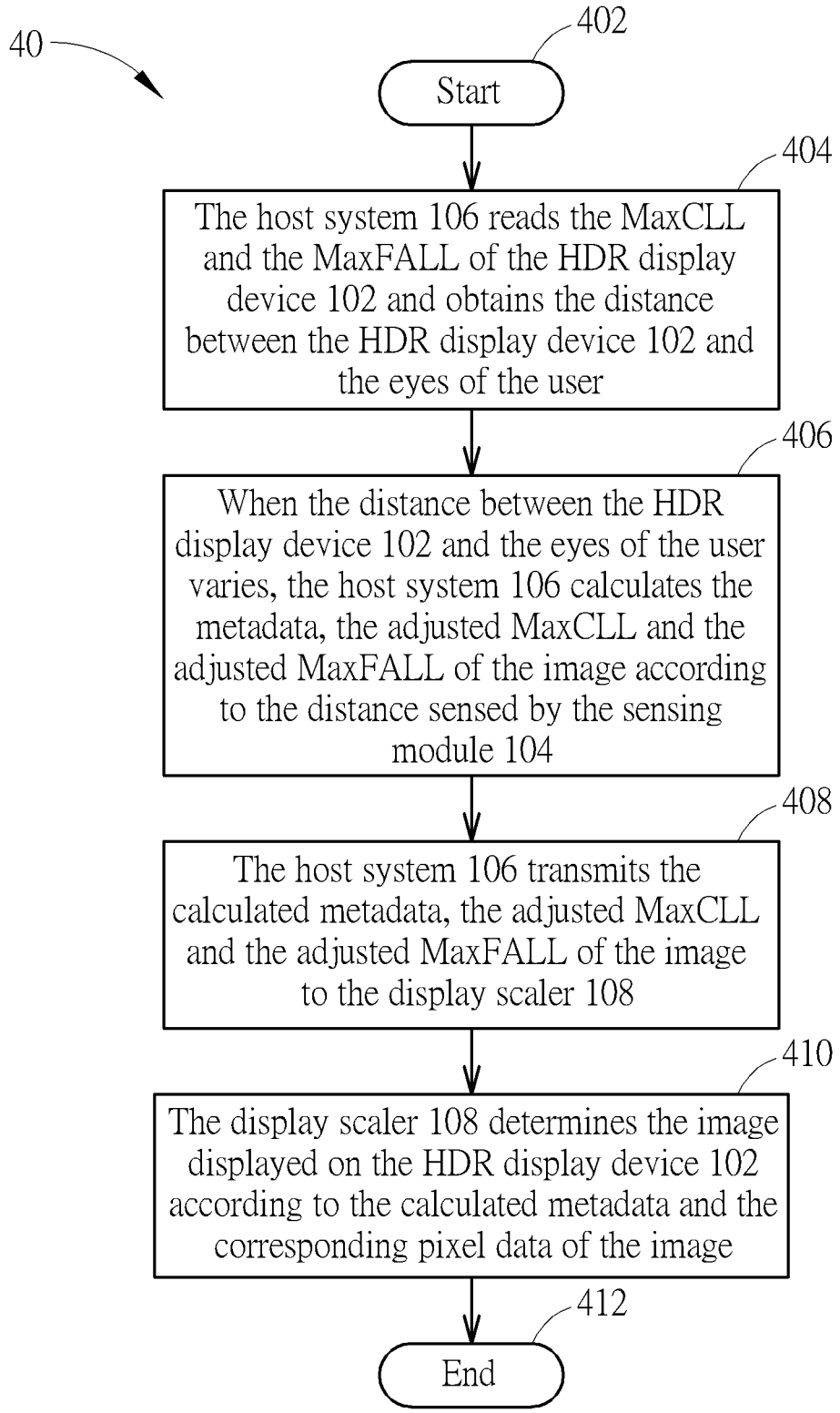
Figure 5:
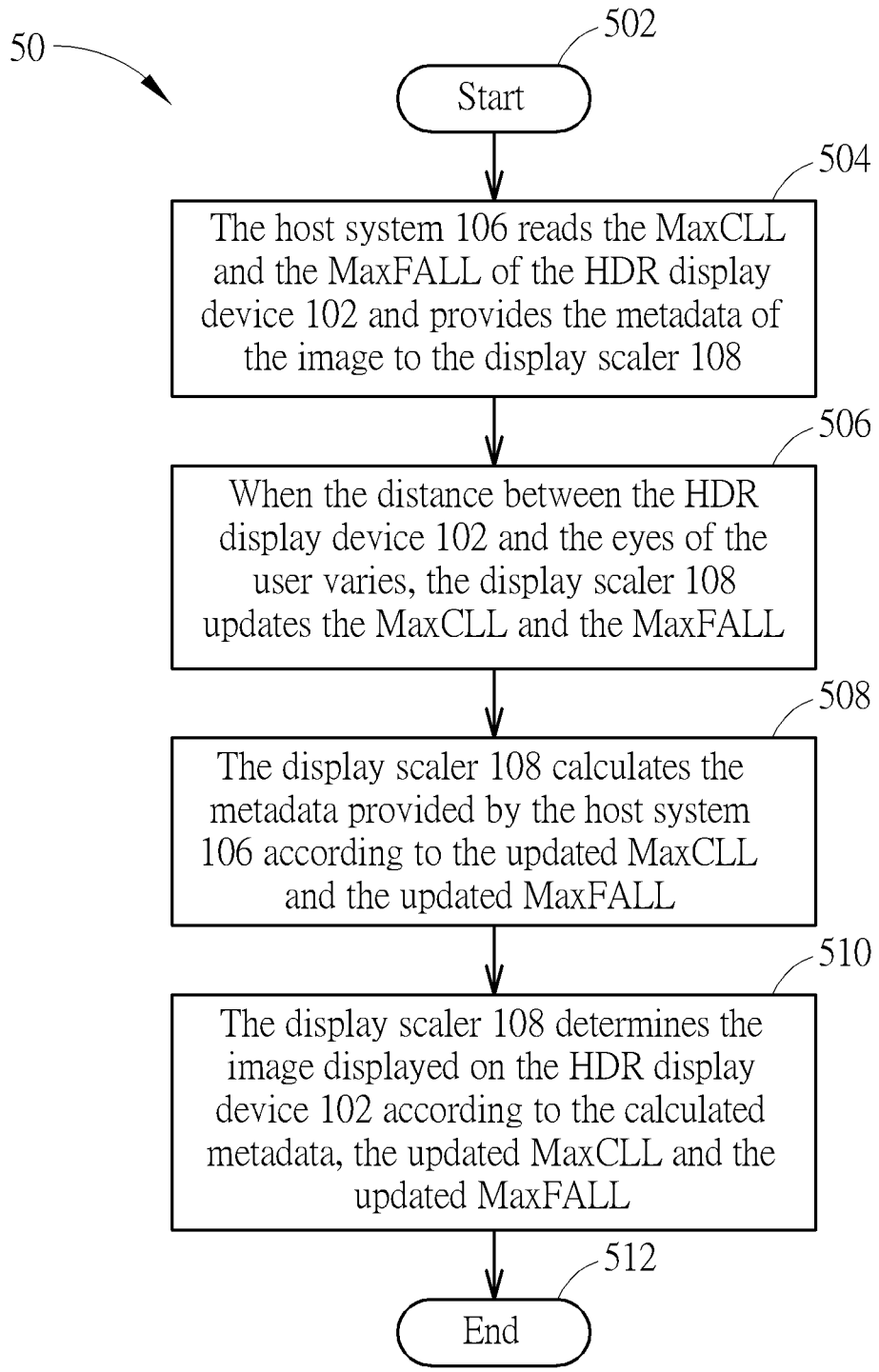

An operation of the display system 10 may be illustrated by a brightness adjustment method 20, as shown in FIG. 2. The brightness adjustment method 20 includes the following steps:

Step 202: Start;

Step 204: Detect the distance between the HDR display device 102 and eyes of the user;

Step 206: Adjust the brightness of the image of the HDR display device 102 according to the distance;

Step 208: Calculate the metadata of the image according to the brightness of the image;

Step 210: Determine the image displayed on the HDR display device 102 according to the calculated metadata of the image;

Step 212: End.

Operations of the brightness adjustment method 20 can be understood by referring to the above embodiments regarding the display system 10, and are not narrated herein for brevity.

Steps 206-210 of the brightness adjustment method 20 may be implemented by the host system 106 and the display scaler 108, and the implementation method may be represented by brightness adjustment methods 30, 40 and 50. The brightness adjustment method 30 includes the following steps:

Step 302: Start;

Step 304: The host system 106 reads the MaxCLL and the MaxFALL of the HDR display device 102, and the display scaler 108 obtains the distance between the HDR display device 102 and the eyes of the user;

Step 306: The display scaler 108 updates the MaxCLL and the MaxFALL when the distance between the HDR display device 102 and the eyes of the user varies, and the display scaler 108 triggers the host system 106 to read the updated MaxCLL and the updated MaxFALL;

Step 308: The host system 106 calculates the metadata of the image according to the updated MaxCLL and the updated MaxFALL;

Step 310: The host system 106 transmits the calculated metadata of the image to the display scaler 108;

Step 312: The display scaler 108 determines the image displayed on the HDR display device 102 according to the calculated metadata and the corresponding pixel data;

Step 314: End.

The brightness adjustment method 40 includes the following steps:

Step 402: Start;

Step 404: The host system 106 reads the MaxCLL and the MaxFALL of the HDR display device 102 and obtains the distance between the HDR display device 102 and the eyes of the user;

Step 406: When the distance between the HDR display device 102 and the eyes of the user varies, the host system 106 calculates the metadata, the adjusted MaxCLL and the adjusted MaxFALL of the image according to the distance sensed by the sensing module 104.

Step 408: The host system 106 transmits the calculated metadata, the adjusted MaxCLL and the adjusted MaxFALL of the image to the display scaler 108;

Step 410: The display scaler 108 determines the image displayed on the HDR display device 102 according to the calculated metadata and the corresponding pixel data of the image;

Step 412: End.

The brightness adjustment method 50 includes the following steps:

Step 502: Start;

Step 504: The host system 106 reads the MaxCLL and the MaxFALL of the HDR display device 102 and provides the metadata of the image to the display scaler 108;

Step 506: When the distance between the HDR display device 102 and the eyes of the user varies, the display scaler 108 updates the MaxCLL and the MaxFALL;

Step 508: The display scaler 108 calculates the metadata provided by the host system 106 according to the updated MaxCLL and the updated MaxFALL;

Step 510: The display scaler 108 determines the image displayed on the HDR display device 102 according to the calculated metadata, the updated MaxCLL and the updated MaxFALL;

Step 512: End.

The above brightness adjustment methods 30, 40 and 50 are respectively implemented by the host system 106 and the display scaler 108 to execute steps 206-210 of the brightness adjustment method 20.

Therefore, the display system 10 according to an embodiment of the present invention may adjust the brightness of the image of the HDR display device 102 according to the distance between the HDR display device 102 and the user's eyes, such that the most appropriate image may be displayed on the display panel 110 of the HDR display device 102.

Notably, those skilled in the art may make proper modifications to the display system according to different requirements. For example, numbers of the first distance and the second distance and parameters of the HDR display device are not limited thereto and can be modified according to different user's preferences or system settings, which are all within the scope of the present invention.

In summary, the present invention provides a brightness adjustment method and a related display system, which dynamically adjusts the brightness of the display according to the distance between the display device and eyes of the user to present an appropriate image.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A brightness adjustment method for a display system, the display system including a high dynamic range (HDR) display device, wherein the HDR display device is utilized for displaying image, the brightness adjustment method comprising:

detecting a distance between the HDR display device and a user;

updating a brightness of the image according to the distance, wherein the brightness is related to at least one of a Maximum Content Light Level (MaxCLL), a Maximum Frame Average Light Level (MaxFALL) and a Minimum Content Light Level (MinCLL) of the HDR display device;

calculating metadata corresponding to the image according to the brightness of the image;

determining the image displayed on the HDR display device according to the calculated metadata corresponding to the image, reducing the MaxFALL of the HDR display device when the distance is smaller than a first distance; and increasing the MinCLL of the HDR display device when the distance is larger than a second distance.

2. The brightness adjustment method of claim 1, further comprising:

reading, by a host system, the MaxCLL and the MaxFALL of the HDR display device; obtaining, by a display scaler, the distance between the HDR display device and the user;

updating, by the display scaler, the MaxCLL and the MaxFALL when the distance varies, and triggering the host system to read an updated MaxCLL and an updated MaxFALL;

calculating, by the host system, the metadata corresponding to the image according to the updated MaxCLL and the updated MaxFALL;

transmitting, by the host system, the calculated metadata corresponding to the image to the display scaler; and determining, by the display scaler, the image displayed on the HDR display device according to the calculated metadata and corresponding pixel data.

3. The brightness adjustment method of claim 1, further comprising:

reading, by a host system, the MaxCLL and the MaxFALL of the HDR display device, and obtaining the distance between the HDR display device and the user;

calculating, by the host system, the metadata of the image, an updated MaxCLL and an updated MaxFALL according to the distance, when the distance varies;

transmitting, by the host system, the calculated metadata, the updated MaxCLL and the updated MaxFALL of the image to a display scaler; and determining, by the display scaler, the image displayed on the HDR display device according to the calculated metadata and corresponding pixel data.

4. The brightness adjustment method of claim 1, further comprising:

reading, by a host system, the MaxCLL and the MaxFALL of the HDR display device, and providing the metadata of the image to a display scaler;

updating, by the display scaler, the MaxCLL and the MaxFALL when the distance varies;

calculating, by the display scaler, the metadata corresponding to the image from the host system according to an updated MaxCLL and an updated MaxFALL; and determining, by the display scaler, the image displayed on the HDR display device according to the calculated metadata, the updated MaxCLL and the updated MaxFALL of the image.

5. The brightness adjustment method of claim 1, further comprising: adjusting the brightness of the image of the HDR display device according to an ambient light where the HDR display device is located.

6. A display system, comprising:

a sensing module, configured to detect a distance between a user and the display system;

a high dynamic range (HDR) display device, configured to display an image, comprising:

a display scaler, coupled to the sensing module, configured to update a brightness of the image; and a display panel, coupled to the display scaler; and a host system, coupled to the HDR display device, configured to provide the metadata of the image;

wherein the metadata of the image and the brightness of the image corresponding to the distance are generated according to the distance sensed by the sensing module, and the display scaler is configured to display the image of the HDR display device according to the calculated metadata of the image and the brightness of the image corresponding to the distance;

wherein the brightness is related to at least one of a Maximum Content Light Level (MaxCLL), a Maximum Frame Average Light Level (MaxFALL) and a Minimum Content Light Level (MinCLL) of the HDR display device;

wherein the display scaler is configured to reduce the MaxFALL of the HDR display device when the distance is smaller than a first distance and increase the MinCLL of the HDR display device when the distance is larger than a second distance.

7. The display system of claim 6, wherein the host system is configured to read Extended display identification data (EDID) to obtain the MaxCLL and the MaxFALL of the HDR display device.

8. The display system of claim 6, wherein the host system is configured to read the MaxCLL and the MaxFALL of the HDR display device, the display scaler is configured to obtain the distance between the HDR display device and the user;

the display scaler is configured to update the MaxCLL and the MaxFALL when the distance is varied, and trigger the host system to read an updated MaxCLL and an updated MaxFALL;

the host system is configured to calculate the metadata corresponding to the image according to the updated MaxCLL and the updated MaxFALL;

the host system is configured to transmit the calculated metadata corresponding to the image to the display scaler; and the display scaler is configured to determine the image displayed on the HDR display device according to the calculated metadata and corresponding pixel data.

9. The display system of claim 6, wherein the host system is configured to read the MaxCLL and the MaxFALL of the HDR display device, and obtain the distance between the HDR display device and the user;

the host system is configured to calculate the metadata of the image, an updated MaxCLL and an updated MaxFALL according to the distance, when the distance varies;

the host system is configured to transmit the calculated metadata, the updated MaxCLL and the updated MaxFALL of the image to the display scaler; and the display scaler is configured to determine the image displayed on the HDR display device according to the calculated metadata and corresponding pixel data of the image.

10. The display system of claim 6, wherein the host system is configured to provide the metadata to the display scaler;

the display scaler is configured to update the MaxCLL and the MaxFALL when the distance varies;

the display scaler is configured to calculate the metadata corresponding to the image from the host system according to an updated MaxCLL and an updated MaxFALL; and the display scaler is configured to determine the image displayed on the HDR display device according to the calculated metadata, the updated MaxCLL and the updated MaxFALL of the image are determined.

11. The display system of claim 6, wherein the host system is configured to adjust the brightness of the image of the HDR display device according to an ambient light where the HDR display device is located.

* * * * *